United States Patent [19]

Nishikawa et al.

[11] Patent Number: 4,623,612

[45] Date of Patent: Nov. 18, 1986

[54] METHOD OF DEVELOPING SILVER HALIDE PHOTOGRAPHIC LIGHT-SENSITIVE MATERIALS

[75] Inventors: Toshihiro Nishikawa; Hatsumi Tanemura, both of Kanagawa, Japan

[73] Assignee: Fuji Photo Film Co., Ltd., Kanagawa, Japan

[21] Appl. No.: 788,702

[22] Filed: Oct. 21, 1985

Related U.S. Application Data

[63] Continuation-in-part of Ser. No. 572,321, Jan. 20, 1984, abandoned.

[30] Foreign Application Priority Data

Jan. 21, 1983 [JP] Japan ..... 58-8181

[51] Int. Cl.[4] ..... G03C 5/50

[52] U.S. Cl. ..... 430/375; 430/377; 430/379; 430/567; 430/569; 430/407; 430/599; 430/603; 430/605

[58] Field of Search ..... 430/567, 569, 407, 377, 430/379, 374, 599, 603, 605, 375

[56] References Cited

U.S. PATENT DOCUMENTS

| | | | |
|---|---|---|---|
| 3,206,313 | 9/1965 | Porter et al. | 430/599 |
| 3,859,093 | 1/1975 | Becker et al. | 430/596 |
| 4,035,185 | 7/1977 | Evans et al. | 430/569 |
| 4,184,878 | 1/1980 | Maternaghan | 430/569 |
| 4,374,914 | 2/1983 | Mollet | 430/559 |
| 4,431,728 | 2/1984 | Abe et al. | 430/559 |
| 4,444,874 | 4/1984 | Silverman et al. | 430/598 |
| 4,444,877 | 4/1984 | Koitabashi et al. | 430/569 |

OTHER PUBLICATIONS

Research Disclosure, Nov. 1977, No. 16345, pp. 45–46.

*Primary Examiner*—Won H. Louie

*Attorney, Agent, or Firm*—Sughrue, Mion, Zinn, Macpeak, and Seas

[57] ABSTRACT

An improved method of developing silver halide photographic light-sensitive materials comprising at least one silver halide emulsion layer on a support is disclosed. In the improvement, said silver halide emulsion layer contains core/shell type silver halide grains having a shell thickness of 25 to 150 Å wherein the surface of the core is subjected to chemical sensitization treatment and the surface of the shell is not subjected to chemical sensitization, and a developing solution contains a solvent for silver halide. It is possible to carry out spectral sensitization without causing a reduction in intrinsic sensitivity and to provide high-speed silver halide light-sensitive materials which are excellent in anti-fading property of latent images and excellent in stabilization with the passage of time using the above-described improved method.

18 Claims, No Drawings

METHOD OF DEVELOPING SILVER HALIDE PHOTOGRAPHIC LIGHT-SENSITIVE MATERIALS

This is a continuation-in-part of application Ser. No. 572,321, filed Jan. 20, 1984 abandoned.

FIELD OF THE INVENTION

The present invention relates to a method of developing photographic light-sensitive materials containing core/shell type silver halide grains with a developing solution containing a solvent for silver halide and, particularly, to a method of developing photographic light-sensitive materials (hereinafter referred to as "sensitive materials") containing a core/shell type silver, halide covered with a very thin shell.

BACKGROUND OF THE INVENTION

The light-sensitive wavelength range of silver halide is in the range of up to blue light, for example, from ultraviolet to 480 mμ in case of silver bromide, which is very different from the wavelength range visible to human eyes. In the field of this art, the sensitivity of silver halide itself (namely, the sensitivity to light up to blue light) is called the intrinsic sensitivity of silver halide.

As a means for extending the sensitivity of silver halide to the longer wavelength range, spectral sensitization techniques using sensitizing dyes are well known in the art, and many studies thereon have been done.

Spectral sensitization techniques using sensitizing dyes are particularly necessary for color sensitive materials as a means of extending the light-sensitive range of the sensitive materials. However, they have the defect of reducing the intrinsic sensitivity of silver halide, though the light sensitivity range is extended.

Therefore, methods of carrying out effective spectral sensitization while preventing a reduction of the intrinsic sensitivity have been much desired.

For example, a method in which the amount of the sensitizing dye is reduced as much as possible in order to prevent a reduction of intrinsic sensitivity is known, but it has the defect that spectral sensitization is insufficient because the amount of the sensitizing dye is too small.

Further, techniques for improving the efficiency of spectral sensitization using dyes having a specific structure as sensitizing dyes have been utilized, but the effect of spectral sensitization itself is still insufficient. Further, since they have defects that they cause a deterioration of silver halide sensitive materials with the passage of time during storage and latent images formed on silver halide fade during the period from exposure to development processing, they are not always satisfactory.

In recent years, it has been highly desired that silver halide sensitive materials have higher sensitivity, and it has been highly desired in this art to develop a method of effectively carrying out spectral sensitization.

SUMMARY OF THE INVENTION

Accordingly, the first object of the present invention is to provide a method of effectively carrying out spectral sensitization without causing a reduction in intrinsic sensitivity.

The second object is to provide high speed silver halide sensitive materials which are excellent in antifading property of latent images and excellent in stabilization with the passage of time.

These objects of the present invention have been attained by providing a method of developing silver halide sensitive materials comprising at least one silver halide emulsion layer on a base, which is characterized by that said silver halide emulsion layer contains core-shell type silver halide grains having a shell thickness of 25 to 150 Å wherein the surface of the core is subjected to chemical sensitization and the surface of the shell is not subjected to chemical sensitization, and wherein a developing solution contains a solvent for silver halide.

DETAILED DESCRIPTION OF THE INVENTION

Core/shell type silver halide grain means a silver halide grain which is prepared by a method comprising forming a core of silver halide grain, carrying out chemical sensitization of the surface of the grain, and thereafter covering the surface of the core with silver halide to form a shell.

The silver halide of the core part in the core/shell type silver halide grains is preferred to be silver iodobromide containing 0 to 10 mol % of silver iodide and the silver halide of the shell part is preferred to be silver iodobromide containing 0 to 10 mol % of silver iodide. Preferably, as the silver halide of the shell part, silver iodobromide containing 0 to 5 mol % of silver iodide is used. In the core part and the shell part, the silver halides may have the same composition or may have different compositions.

In the present invention, the process for preparing the core/shell type silver halide is not restricted. For example, the core/shell type silver halide can be prepared by a process which comprises forming the core part by a single jet process, a double jet process or a pAg controlled double jet process, etc., processing the surface of the core part with conventional chemical sensitizers such as a gold sensitizer, a sulfur sensitizer or a reduction sensitizer, etc., and forming a shell on the core surface by a double jet process or a pAg controlled double jet process by adding silver compounds and halogen compounds at the same time.

As methods of chemical sensitization of the core, it is possible to use, for example, the methods described in *Die Grundlagen der Photographischen Prozesse mit Silberhalogeniden,* edited by H. Frieser (Akademische Verlagsgesellschaft, 1968), pages 675–734.

Namely, it is possible to use sulfur sensitization using sulfur containing compounds capable of reacting with active gelatin or silver (for example, thiosulfates, thioureas, mercapto compounds and rhodanines), reduction sensitization using reducing substances (for example, stannous salts, amines, hydrazine derivatives, formamidinesulfinic acid and silane compounds) and noble metal sensitization using noble metal compounds (for example, gold complex salts and complex salts of metals of Group VIII in the Periodic Table (short periodic type) such as Pt, Ir or Pd, etc.), which are used alone or as a combination thereof. The Periodic Table is described in *Encyclopaedia Chimica,* Vol. 4, page 618 (1967), published by Kyoritsu Shuppan Kabushiki Kaisha (Japan).

Examples of sulfur sensitization are described in U.S. Patent Nos. 1,574,944, 2,410,689, 2,278,947, 2,728,668 and 3,656,955, etc., examples of reduction sensitization are described in U.S. Pat. Nos. 2,983,609, 2,419,974 and 4,054,458, etc., and examples of noble metal sensitization are described in U.S. Pat. Nos. 2,399,083 and 2,448,060 and British Pat. No. 618,061.

The characteristics of the present invention are that the core/shell type silver halide grains have a very thin shell thickness and that such core/shell type silver halide grains having a very thin shell thickness are developed with a developing solution containing a solvent for silver halide. General core/shell type silver halide grains are well-known in the art.

For example, U.S. Pat. No. 3,206,313 discloses a technique of improving reciprocity law failure, etc., wherein the surface of a chemically sensitized core is covered with a shell which is not chemically sensitized to prepare core/shell type silver halide grains having low surface sensitivity and high interior sensitivity. However, the effect of the present invention cannot be sufficiently obtained because the thickness of the shell part of the core/shell type silver halide grain is 0.25 to 8 times that of the core part (a shell thickness of about 300 to 8,000 Å), i.e., the shell is very thick. Since the shell is too thick, it is impossible to completely develop latent images on the core surface, even if it is processed with a developing solution containing a solvent for silver halide, and, consequently, sufficient sensitivity is not obtained.

Similarly, core/shell type silver halide grains are disclosed in Japanese Patent Publication No. 12579/80, but the effect of the present invention cannot be sufficiently obtained because the silver halide grains in the examples thereof have a very thick shell, about 1,500 Å.

Further, Japanese Patent Application (OPI) No. 154232/82 (the term "OPI" as used herein refers to a "published unexamined Japanese patent application") discloses a technique of improving sensitivity and covering power wherein core/shell type silver halide grains are composed of a shell having a thickness of 100 to 1,000 Å which does not contain silver iodide, applied to the surface of a core composed of silver iodobromide. However, as will be obvious from the examples of this Japanese Patent Application, the surface of the shell of the core/shell type silver halide grains is subjected to chemical sensitization.

A regular type of silver halide crystal such as silver halide crystal having a cubic, hexhedral or tetradecahedral structure is preferred. The silver halide grains are preferably in the form of a monodispersed emulsion having a narrow grain size distribution.

Preferably, the silver halide crystals are not of the twinned type, such as those described in U.S. Pat. No. 4,184,878.

The core/shell type silver halide of the present invention is characterized by the surface of the shell not being substantially subjected to chemical sensitization treatment. Because chemical sensitization centers and the sensitizing dye are separated by the shell, this prevents any harmful influence such as destruction of latent images caused by direct contact with chemical sensitization centers in the case that the sensitizing dye is adsorbed on the surface of the silver halide grain.

Accordingly, it is essential that the surface of the core/shell type silver halide grains of the present invention not be subjected to chemical sensitization, which is different from the technique described in the above Japanese Patent Application.

Further, British Pat. No. 1,458,764 discloses a technique wherein chemical sensitization centers are formed on the surface of the core and areas where chemical sensitization centers are not present are covered with a shell so that chemical sensitization centers are placed in the hollow part and the shell thickness (namely, depth of the hollow part) is a repeating unit of 5 to 50 in the lattice face, whereby desensitization by a sensitizing dye in the case of carrying out development with a surface developing solution is prevented.

However, the technique disclosed in the above British Patent is different from the present invention in the points that chemical sensitization centers are exposed on the surface even it is present in the hollow part, and the developing solution used does not contain a solvent for silver halide.

The core of the core-shell type silver halide grains of the present invention is not fogged.

If the core in the core/shell silver halide material is fogged, the core/shell silver halide material must be developed at both imaged parts and non-imaged parts in the first development step. The reason is that since a first developing solution for a color reversal development contains a solvent for silver halide, the silver halide grains treated are developed in the interior of the grains. Thus, when core/shell type grains are used, the grains are developed up to the core portion with the first developing solution.

In the usual color reversal system, silver halide grains which exist in the non-imaged parts which are not developed in the first development step are fogged in a reversal step and, then, treated with a color developing solution to obtain color images. When core/shell type silver halide grains in which the cores are previously fogged are used in the color reversal system described above (containing fogged cores), silver halide grains existing in both imaged parts and non-imaged parts are developed in the first development step. Such wholly developed silver halide grains then cannot provide a color image in the color development step. In contrast, the present invention can provide color images when used in a color reversal system.

As described above, the core/shell type silver halide grains of the present invention are characterized by the shell thickness being 25 to 150 Å.

If the shell is thicker than 150 Å, the progress of development is inferior because latent images formed on the core surface are not sufficiently developed even if processed with a developing solution containing a solvent for silver halide, and, consequently, undesired results are obtained, for example, sufficient sensitivity is not obtained.

On the other hand, if the shell is thinner than 25 Å, a reduction of intrinsic sensitivity is caused by the sensitizing dye to result in undesirable results as chemical sensitization centers on the core surface cannot be sufficiently covered.

The particle size of the core/shell type silver halide grains of the present invention is not restricted, but it is preferred to be in a range of 0.1 to 5 μm and, preferably, 0.1 to 3 μm.

As solvents for silver halide used in the developing solution of the present invention, there are compounds having chemical species such as $SCN^-$, $SO_3^{2-}$ $S_2O_5^{2-}$ and $S_2O_3^{2-}$, etc.

Examples include KSCN, NaSCN, $K_2SO_3$, $Na_2SO_3$, $K_2S_2O_5$, $Na_2S_2O_5$, $K_2S_2O_3$ and $Na_2S_2O_3$.

Since the progress of development is slow if the amount of these solvents for silver halide used is too small, or fog is formed in the silver halide emulsion if it is too large, there is naturally a suitable amount of the solvents for silver halide used, but determination of the amount can be easily carried out by persons skilled in the art.

For example, in the case of using $SCN^-$, it is preferably used in the range of 0.005 to 0.02 mol, more preferably 0.01 to 0.015 mol, per liter of the developing solution. In the case of using $SO_3^{2-}$, it is preferably used in the range of 0.05 to 1 mol, more preferably 0.1 to 0.5 mol, per liter of the developing solution. In the case of using $S_2O_5^{2-}$, it is preferably used in the range of 0.025 to 0.5 mol, more preferably 0.05 to 0.25 mol, per liter of the developing solution. In the case of using $S_2O_3^{2-}$, it is preferably used in the range of 0.005 to 0.02 mol, more preferably 0.01 to 0.015 mol, per liter of the developing solution.

As silver halide sensitive materials capable of use in the present invention, there are color reversal photographing sensitive materials, black and white negative photographing sensitive materials, black and white printing papers and radiographic sensitive materials, etc.

The photographic emulsions of the present invention are spectrally sensitized with methine dyes or other dyes. These sensitizing dyes may be used alone, but they can be used as a combination thereof. Combinations of sensitizing dyes are often used for the purpose of supersensitization. The emulsions may contain dyes which do not have a spectral sensitizing function themselves or substances which do not substantially absorb visible light but have a supersensitization function together with the sensitizing dyes.

Useful sensitizing dyes, combinations of dyes which have a supersensitization function and substances which have a supersensitization function are described in *Research Disclosure,* Vol. 176, 17643 (published in December, 1978), page 23, IV, paragraph J.

Examples of useful sensitizing dyes are described in German Pat. No. 929,080, U.S. Pat. Nos. 2,493,748, 2,503,776, 2,519,001, 2,912,329, 3,656,959, 3,672,897 and 4,025,349, British Pat. No. 1,242,588 and Japanese Patent Publication No. 14030/69.

These sensitizing dyes may be used alone, but they can be used as a combination thereof. Combinations of sensitizing dyes are often used for the purpose of supersensitization. Examples are described in U.S. Pat. Nos. 2,688,545, 2,977,229, 3,387,060, 3,522,052, 3,527,641, 3,617,293, 3,628,964, 3,666,480, 3,672,898, 3,679,428, 3,814,609 and 4,026,707, British Pat. No. 1,344,281, Japanese Patent Publication Nos. 4937/68 and 12375/78 and Japanese Patent Application Nos. (OPI) 110618/77 and 109925/77.

Other aspects of the present invention, for example, the support of the silver halide sensitive material, layer construction, additives for silver halide emulsion layers or other photographic layers (for example, stabilizers, hardeners, binders, surfactants, color couplers, anti-fading agents, high boiling point organic solvents, ultraviolet ray absorbing agents, dyes, matting agents and polymer latexes, etc.), compositions of developing solutions, compositions of bleaching solutions, fixing solutions and bleach-fix solutions, etc., are not restricted; reference can be made to *Research Disclosure,* Vol. 176, pages 22–31 for useful materials, etc. As the binder or the protective colloid for the photographic emulsion layers or other layers, gelatin is advantageously used, but other hydrophilic colloids can also be used.

For example, it is possible to use proteins such as gelatin derivatives, graft polymers of gelatin with other high polymers, albumin or casein, etc.; saccharides such as cellulose derivatives such as hydroxyethyl cellulose, carboxymethyl cellulose or cellulose sulfate, etc.; saccharides such as sodium alginate or starch derivatives, etc., and synthetic hydrophilic high molecular materials such as homopolymers or copolymers of polyvinyl alcohol, polyvinyl alcohol partial acetal, poly-N-vinylpyrrolidone, polyacrylic acid, polymethacrylic acid, polyacrylamide, polyvinylimidazole, polyvinyl pyrazole, etc.

The photographic emulsions of the present invention may contain various compounds for the purpose of preventing fogging of the light-sensitive materials in the process of producing them, during storage or during photographic processing or for the purpose of stabilizing photographic properties. Namely, it is possible to add many compounds known as antifoggants or stabilizers, such as azoles, for example, benzothiazolium salts, nitroimidazoles, triazoles or benzimidazoles (particularly, nitro- or halogen-substituted derivatives); heterocyclic mercapto compounds, for example, mercaptothiazoles, mercaptobenzothiazoles, mercaptobenzimidazoles, mercaptothiadiazoles, mercaptotetrazoles (particularly, 1-phenyl-5-mercaptotetrazole) or mercaptopyrimidines; the above-described heterocyclic mercapto compounds having water-soluble groups such as carboxyl groups or sulfo groups, etc.; thioketo compounds, for example, oxazolinethione; azaindenes, for example, tetraazaindenes (particularly, 4-hydroxy-substituted (1,3,3a,7)tetraazaindenes); benzenethiosulfonic acids; or benzenesulfinic acids, etc.

In the photographic light-sensitive materials of the present invention, the photographic emulsion layers and other hydrophilic colloid layers may contain inorganic or organic hardeners. For example, it is possible to use chromium salts (chromium alum and chromium acetate,, etc.), aldehydes (formaldehyde, glyoxal and glutaraldehyde, etc.), N-methylol compounds (dimethylolurea and methyloldimethylhydantoin, etc.), dioxane derivatives (2,3-dihydroxydioxane, etc.), active vinyl compounds (1,3,5-triacryloyl-hexahydro-s-triazine and 1,3-vinylsulfonyl-2-propanol, etc.), active halogen compounds (2,4-dichloro-6-hydroxy-s-triazine, etc.) and mucohalogenic acids (mucochloric acid and mucophenoxychloric acid, etc.), etc., which may be used alone or as a combination thereof.

The photographic emulsion layers and other hydrophilic colloid layers of the light-sensitive materials of the present invention may contain surface active agents for various purposes, for example, as coating aids, or for prevention of static charges, improvement of lubricating properties, emulsification and dispersion, prevention of adhesion and improvement of photographic properties (for example, acceleration of development, hard toning or sensitization), etc.

For example, it is possible to use nonionic surface active agents such as saponin (steroid type), alkylene oxide derivatives (for example, polyethylene glycol, polyethylene glycol/polypropylene glycol condensates, polyethylene glycol alkyl ethers, polyethylene glycol alkylaryl ethers, polyethylene glycol esters, polyethylene glycol sorbitan esters, polyalkylene glycol alkylamines or amides, and polyethylene oxide addition products of silicone), glycidol derivatives (for example, alkenylsuccinic adid polyglyceride and alkylphenol polyglyceride), aliphatic acid esters of polyhydric alcohols, or alkyl esters of saccharose, etc.; anionic surface active agents containing acid groups such as a carboxyl group, a sulfo group, a phospho group, a sulfuric acid ester group or a phosphoric acid ester group, etc., such as alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyethylene alkylphenyl ethers, or polyoxyethylene alkylphosphoric acid esters, etc.; ampholytic surface active agents such as amino acids, aminoalkylsulfonic acids, aminoalkylsulfuric or phosphoric acid esters, alkylbetaines or amine oxides, etc.; and cationic surface active agents such as alkylamine salts, aliphatic or aromatic quaternary ammonium salts, heterocyclic quaternary ammonium salts such as pyridinium salts or imidazolium salts, etc., aliphatic phosphonium or sulfonium salts or heterocyclic phosphonium or sulfonium salts, etc.

The photographic emulsion layers of the photographic light-sensitive materials of the present invention may contain color forming couplers, namely, compounds capable of coloring by oxidative coupling with an aromatic primary amine developing agent (for example, phenylenediamine derivatives or aminophenol derivatives, etc.) in color development. For example, as magenta couplers, there are 5-pyrazolone couplers, pyrazolobenzimidazole couplers, cyanoacetylcoumarone couplers and ring-opened acylacetonitrile couplers, etc. As yellow couplers, there are acylacetamide couplers (for example, benzoylacetanilides and pivaloylacetanilides), etc. As cyan couplers, there are naphthol couplers and phenol couplers, etc. These couplers preferably ha:e a hydrophobic group called a ballast group in their molecule and are preferably nondiffusible. The couplers may be 4-equivalent or 2-equivalent to silver ions. Further, the couplers may be colored couplers which have an effect of color correction or may be couplers which release a development inhibitor by development (DIR couplers). In addition to DIR couplers, they may contain noncoloring DIR coupling compounds which form a colorless product by coupling and release a development inhibitor.

In order to introduce the couplers into the silver halide emulsion layers, known methods, for example, the method described in U.S. Pat. No. 2,322,027, etc., can be used. For example, they are dispersed in hydrophilic colloids after being dissolved in phthalic acid alkyl esters (dibutyl phthalate or dioctyl phthalate, etc.), phosphoric acid esters (for example, diphenyl phosphate, triphenyl phosphate, tricresyl phosphate or dioctylbutyl phosphate), citric acid esters (for example, tributyl acetyl citrate), benzoic acid esters (for example, octyl benzoate), alkylamides (for example, diethyllaurylamide), aliphatic acid esters (for example, dibutoxyethyl succinate or dioctyl azelate) or trimesic acid esters (for example, tributyl trimesate), etc., or organic solvents having a boiling point of about 30° C. to 150° C. such as lower alkyl acetates such as ethyl acetate or butyl acetate, ethyl propionate, secondary butyl alcohol, methyl isobutyl ketone, $\beta$-ethoxyethyl acetate or methyl cellosolve acetate, etc. The above-described high boiling point organic solvents and low boiling point organic solvents may also be used as a mixture thereof.

Further, the methods of dispersing using polymers described in Japanese Patent Publication No. 39853/76 and Japanese Patent Application (OPI) No. 59943/76 can be used.

In the case that the couplers have acid groups such as a carboxylic acid group or a sulfonic acid group, they are introduced as an alkaline aqueous solution into the hydrophilic colloids.

In the light-sensitive materials of the present invention, the hydrophilic colloid layers may contain ultraviolet ray absorbing agents. For example, it is possible to use benzotriazole compounds substituted with aryl groups, 4-thiazolidone compounds, benzophenone compounds, cinnamic acid ester compounds, butadiene compounds, benzoxazole compounds and ultraviolet ray absorbing polymers, etc. These ultraviolet ray absorbing agents may be fixed in the above-described hydrophilic colloid layers.

In carrying out the present invention, the following known antifading agents can be used. Further, the color image stabilizers used in the present invention may be used alone or as a combination of two or more thereof. Examples of known antifading agents include hydroquinone derivatives, gallic acid derivatives, p-alkoxyphenols, p-oxyphenol derivatives and bisphenols, etc.

The present invention can be applied to multilayer color photographic materials having at least two layers each having a different spectral sensitivity on a support. Multilayer color photographic materials generally have at least one red-sensitive emulsion layer, at least one green-sensitive emulsion layer and at least one blue-sensitive emulsion layer on a support. The order of these layers can be suitably selected. Generally, the red-sensitive emulsion layer contains a cyan forming coupler, the green-sensitive emulsion layer contains a magenta forming coupler, and the blue-sensitive emulsion layer contains a yellow forming coupler. If necessary, other combinations can also be used.

By "a positive image is formed by two development steps" it is meant that the present invention is directed to conventional development methods where a negative image is formed by black and white photographic processing in a first development, and is followed by reversal processing and color development processing, such as the negative-positive process and a color reversal process. The present invention does not involve processing where a positive image is formed in a first development such as direct positive processing.

In order to carry out photographic processing per the present invention, it is possible to utilize known processes and known processing solutions wherein a solvent for silver halide is contained in the developing solution, as described in, for example, *Research Disclosure,* Vol. 176, pages 28–30. The photographic processing may be either photographic processing for forming silver images (black and white photographic processing) or photographic processing for forming dye images (color photographic processing) as the occasion demands. The processing temperature is generally selected from the range of 18° C. to 50° C., but a temperature of lower than 18° C. or a temperature of higher than 50° C. may be used.

The developing solution used in the case of carrying out black and white photographic processing may contain known developing agents. As the developing agents, dihydroxybenzenes (for example, hydroquinone), 3-pyrazolidines (for example, 1-phenyl-3-pyrazolidone) and aminophenols (for example, N-methyl-p-aminophenol), etc., can be used alone or as a combination thereof. The developing solution generally contains known preservatives, alkali agents, pH buffer agents and antifogging agents, etc.

As the fixing solution, one having a composition conventionally used can be used. As fixing agents, not only thiosulfates and thiocyanates but also organic sulfur compounds which are known to have an effect as a fixing agent can be used. The fixing solution may contain water-soluble aluminum salts as hardening agents.

In the case of forming dye images, conventional processes can be utilized. For example, there is a negative-positive process (described in, for example, *Journal of the Society of Motion Picture and Television Engineers,* Vol. 61 (1953), pages 667–701), and a color reversal process for forming dye positive images which comprises developing with a first developing solution containing a black and white developing agent to form negative silver images, carrying out at least one uniform exposure or another suitable fogging treatment, and thereafter carrying out color development. The first developing solution comprises, for example, 0.5 to 30 g/l of a black ahd white developing agent, 0.005 to 1 mol/l of a solvent for silver halide, 5 to 100 g/l of a sulfite and 1 to 10,000 mg/l of a halide and is adjusted to pH of 9 to 11, preferably 9.3 to 10 by a pH buffer agent. The color developing solution generally consists of an alkaline aqueous solution containing a color developing agent. As the color developing agent, it is possible to use known primary aromatic amine developing agents such as phenylenediamines (for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-62 -hydroxyethylaniline, 3-methyl-4-amino-N-ethyl-N-β-methanesulfonamidoethylaniline and 4-amino-3-methyl-N-ethyl-N-β-methoxyethylaniline, etc.).

In addition, those agents described in *Phototraphic Processing Chemistry,* written by L. F. A. Mason (Focal Press, 1966), pages 226–229, U.S. Pat. Nos. 2,193,015 and 2,592,364 and Japanese Patent Application (OPI) No. 64933/73, etc., may be used.

The color developing solution can contain pH buffer agents, development restrainers and antifogging agents. If necessary it may contain water softeners, preservatives, organic solvents, development accelerators, dye forming couplers, competing couplers, fogging agents, auxiliary developing agents, viscosity increasing agents, polycarboxylic acid type chelating agents and antioxidants, etc.

The photographic emulsion layer(s) after color development is generally subjected to a bleaching. The bleaching may be carried out simultaneously with fixing or they may be carried out sequentially. As bleaching agents, compounds of polyvalent metals such as iron (III), cobalt (III), chromium (VI) or copper (II), etc., peracids, quinones and nitroso compounds, etc., are useful.

To the bleaching solution or the bleach-fixing solution, it is possible to add bleaching accelerators as described in U.S. Pat. Nos. 3,042,52and 3,241,966 and Japanese Patent Publication Nos. 8506/70 and 8836/70, etc., thiol compounds described in Japanese Patent Application (OPI) No. 65732/78, and other various additives.

Having thus generally defined the invention, the following Examples are offered to illustrate preferred forms thereof.

EXAMPLE 1

A photographic emulsion comprising mono-dispersed octahedral grains of silver iodobromide containing 2.5 mol % of silver iodide was subjected to gold sensitization and sulfur sensitization.

As the gold sensitizer, tetrachloroaurate and potassium thiocyanate were used together.

As the sulfur sensitizer, hypo was used.

To the resultant photographic emulsion, an aqueous solution of silver nitrate and an aqueous solution of potassium halide (aqueous solution of a mixture of KBr and KI) were added at the same time by a double jet process to cover the grains with a shell composed of silver iodobromide containing 2.5 mol % of silver iodide. The thickness of the shell was varied as shown in Table 1.

To the resultant core/shell type emulsion, 3,3′-di(3-sulfopropyl)-9-ethyl-naphtho[1,2-d]thiacarbocyanine sodium salt and 5,5′-dichloro-3,3′-di(3-sulfobutyl)-9-ethylthiacarbocyanine sodium salt were added in an amount of $2.6\times10^{-4}$ mol per mol of silver halide, respectively, as sensitizing dyes to carry out spectral sensitization.

Further, an emulsion which was prepared by dissolving a mixture composed of 70 g of 2-(heptafluorobutyramide)-5-[2′-(2″,4″-di-t-amylphenoxy)-butyramide]phenol and 30 g of 2-(heptafluorobutyramide)-5-[2′(2″,4″-di-t-amylphenoxy)hexylamide]phenol as cyan couplers in a mixture composed of 50 cc of tricresyl phosphate and 100 cc of ethyl acetate, and stirring at a high rate together with 1 kg of a 10% aqueous solution of gelatin, was added to the above-described emulsion and, further, a stabilizer, a conventional pH controller and a viscosity increasing agent were added thereto. The resultant emulsion containing a silver halide and a gelatin in a weight ratio of 1.2:1 was applied so as to provide a coated silver amount of 20 mg/100 $cm^2$.

Further, to the resultant light-sensitive layer, a layer comprising gelatin, a matting agent, a pH controller, a surface active agent, a viscosity increasing agent and a hardening agent was applied as a surface protective layer so as to provide a dry film thickness of 1.5 μm, and the same was dried.

The resulting Samples 1 to 9 were exposed to light and subjected to development processing at the following conditions. The processing used here was a color reversal treatment, whereby a cyan dye image was obtained. In this processing, sodium sulfite and potassium thiocyanate were used as solvents for silver halide in the first development stage. Exposure to light was carried out using a light source having a color temperature of 4,800° K. through an optical wedge and a sharp cut filter of a wavelength 500 nm for 1/100

| Processing Step: | Time | Temperature |
|---|---|---|
| First Development | 6′ | 38° C. |
| Water Wash | 2′ | " |
| Reversal | 2′ | " |
| Color Development | 6′ | " |
| Adjustment | 2′ | " |
| Bleaching | 6′ | " |
| Fixing | 4′ | " |
| Water Wash | 4′ | " |
| Stabilization | 1′ | Normal Temperature |
| Drying | | |

The compositions of the processing solutions were as follows.

| First Development: | |
|---|---|
| Water | 700 ml |

-continued

| | |
|---|---|
| Sodium Tetrapolyphosphate | 2 g |
| Sodium Sulfite | 20 g |
| Hydroquinone Monosulfonate | 30 g |
| Sodium Carbonate (1 hydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% aq. soln.) | 2 ml |
| Water to make | 1,000 ml |
| Reversal: | |
| Water | 700 ml |
| Nitrilo—N,N,N—-trimethylenephosphonic Acid (6 Na salt) | 13 g |
| Stannous Chloride (2 hydrate) | 1 g |
| Sodium Hydroxide | 8 g |
| Glacial Acetic Acid | 15 ml |
| p-Aminophenol | 1 mg |
| Water to make | 1,000 ml |
| Color Development: | |
| Water | 700 ml |
| Sodium Tetrapolyphosphate | 2 g |
| Sodium Sulfite | 7 g |
| Sodium Tertiary Phosphate (12 hydrate) | 36 g |
| Potassium Bromide | 1 g |
| Potassium Iodide (0.11% soln.) | 90 ml |
| Sodium Hydroxide | 3 g |
| Citrazinic Acid | 1.5 g |
| N—Ethyl—N—(β-methanesulfonamidoethyl)-3-methyl-4-aminoaniline Sulfate | 11 g |
| Ethylenediamine | 3 g |
| Water to make | 1,000 ml |
| Adjustment: | |
| Water | 700 ml |
| Sodium Sulfite | 12 g |
| Sodium Ethylenediaminetetraacetate (2 hydrate) | 8 g |
| Thioglycerine | 0.4 ml |
| Glacial Acetic Acid | 3 ml |
| Water to make | 1,000 ml |
| Bleaching: | |
| Water | 800 ml |
| Sodium Ethylenediaminetetraacetate (2 hydrate) | 2.0 g |
| Ethylenediaminetetraacetato Iron (III) Ammonium Complex (2 hydrate) | 120.0 g |
| Potassium Bromide | 100.0 g |
| Water to make | 1,000 ml |
| Fixing: | |
| Water | 800 ml |
| Ammonium Thiosulfate | 80.0 g |
| Sodium Sulfite | 5.0 g |
| Sodium Bisulfite | 5.0 g |
| Water to make | 1,000 ml |
| Stabilization: | |
| Water | 800 ml |
| Formalin (37% by weight) | 5.0 ml |
| Fuji Driwel ® | 5.0 ml |
| Water to make | 1,000 ml |

TABLE 1

| Sample No. | Shell Thickness (Angstroms) | Color Sensitized Sensitivity* |
|---|---|---|
| 1 (Comparison) | 0 | 1.58 |
| 2 (Comparison) | 15 | 1.73 |
| 3 (The Present Invention) | 25 | 1.85 |
| 4 (The Present Invention) | 35 | 1.97 |
| 5 (The Present Invention) | 53 | 2.02 |
| 6 (The Present Invention) | 101 | 1.97 |
| 7 (The Present Invention) | 130 | 1.90 |
| 8 (The Present Invention) | 150 | 1.84 |
| 9 (Comparison) | 200 | 1.60 |

*Color sensitized sensitivity is represented by the logarithm of the reciprocal of the relative exposure which gives an optical density of $(D_{max} + D_{min})/2$ wherein $D_{max}$ is the optical density of the image in the case of zero exposure and $D_{min}$ is the optical density of the image in the case of infinitely great exposure.

As is obvious from Table 1, the color sensitized sensitivity is high in Samples 3 to 8 of the present invention having a shell thickness of 25 to 150 Å.

It is also seen that Samples 4 to 6 having a shell thickness of 35 to 101 Å are particularly excellent.

EXAMPLE 2

An emulsion comprising silver iodobromide cubic grains containing 4.0 mol % of silver iodide (particle size: 0.6 μm) was subjected to gold sensitization and sulfur sensitization in the same manner as in Example 1.

To this emulsion, a fine grain silver bromide emulsion which was not chemically sensitized (particle size: 0.05 μm) was added, and the mixture was stirred at 63° C. for 20 minutes.

The fine grain silver bromide was dissolved and then separated out on the surface of the silver iodide grains, whereby a core/shell type emulsion having a shell thickness as shown in Table 2 was prepared.

The resultant emulsion was spectrally sensitized by adding the same sensitizing dyes as used in Example 1. Further, various additives were added similarly to Example 1. The emulsion containing a silver halide and a gelatin in a weight ratio of 1.2:1 was applied simultaneously with applying a surface protective layer as in Example 1 to produce Samples 10 to 17.

Samples 10 to 17 were processed in the same manner as in Example 1 and the results shown in Table 2 were obtained.

TABLE 2

| Sample No. | Shell Thickness (Angstroms) | Color Sensitized Sensitivity* |
|---|---|---|
| 10 (Comparison) | 0 | 2.00 |
| 11 (Comparison) | 15 | 2.05 |
| 12 (The Present Invention) | 25 | 2.09 |
| 13 (The Present Invention) | 50 | 2.15 |
| 14 (The Present Invention) | 75 | 2.18 |
| 15 (The Present Invention) | 100 | 2.17 |
| 16 (The Present Invention) | 150 | 2.10 |
| 17 (Comparison) | 200 | 1.95 |

*Same as per Example 1

As is obvious from Table 2, the color sensitized sensitivity is high in Samples 12 to 16 of the present invention which have a shell thickness of 25 to 150 Å.

EXAMPLE 3

To a triacetyl cellulose support having an undercoating layer, emulsion layers and auxiliary layers were applied in the following order to obtain Sample 18.

1st Layer: Low Speed Red-Sensitive Emulsion Layer 500 g of an emulsion obtained by dissolving 100 g of 2-(heptafluorobutyramide)-5-[2′-(2″,4″-di-t-amino-phenoxy)butyramide]phenol as a cyan coupler in a mixture of 100 cc of tricresyl phosphate and 100 cc of ethyl acetate and stirring together with 1 kg of a 10% aqueous solution of gelatin at a high rate was blended with 1 kg of a red-sensitive low speed silver iodobromide emulsion (particle size: 0.4 μm). The resultant emulsion was applied so as to result in a dry film thickness of 2 μm(silver amount: 0.5 g/m$^2$).

The emulsion used had an iodine content of 4.5 mol % and an average particle size of 0.35 μm, which was subjected to gold sensitization and sulfur sensitization.

As the gold sensitizer, tetrachloroaurate was added in an amount of $1.1\times10^{-5}$ g/g silver calculated as gold, and, as the sulfur sensitizer, hypo was added in an amount of $3.0\times10^{-5}$ g/g silver. The emulsion was chemically aged at a temperature of 63° C. for 50 minutes at a pAg of about 9.0.

As a gelatin hardener, 1,2-bis(vinylsulfonylacetamide)ethane was used.

2nd Layer: High Speed Red-Sensitive Emulsion Layer 1,000 g of an emulsion obtained by dissolving 100 g of 2-(heptafluorobutyramide)-5-[2'-(2'',4''-di-t-aminophenoxy)butyramide]phenol as a cyan coupler in a mixture of 100 cc of tricresyl phosphate and 100 cc of ethyl acetate and stirring together with 1 kg of a 10% aqueous solution of gelatin at a high rate was blended with 1 kg of a red-sensitive high-speed silver iodobromide emulsion (particle size: 0.06 μm). The resultant emulsion was applied so as to result in a dry film thickness of 1 μm(silver amount: 0.4 g/m$^2$).

The emulsion used had an iodine content of 3.5 mol % and an average particle size of 0.6 μm, which was chemically sensitized at pAg 9.0 using tetrachloroaurate in an amount of $0.5\times10^{-5}$ g/g silver calculated as gold and hypo in an amount of $1.2\times10^{-5}$ g/g silver.

3rd Layer: Intermediate Layer 1 kg of an emulsion obtained by dissolving 2,5-di-t-octylhydroquinone in a mixture of 100 cc of dibutyl phthalate and 100 cc of ethyl acetate and stirring together with 1 kg of a 10% aqueous solution of gelatin at a high rate was with 1 kg of 10% aqueous solution of gelatin, and the resultant emulsion was applied so as to result in a dry film thickness of 1.5 μm.

4th Layer: Low Speed Green-Sensitive Emulsion Layer 500 g of an emulsion which was obtained in the same manner as in the emulsion of the 1st layer, except that 1-(2,4,6-trichlorophenyl)-3-[3-(2,4-di-t-amylphenoxy)acetamide)benzamide]-5-pyrazolone was used as a magenta coupler instead of the cyan coupler, was blended with 1 kg of a green-sensitive low speed silver iodobromide emulsion (iodine content: 4.5 mol %, and particle size: 0.5 μm), and the resultant emulsion was applied so as to result in a dry film thickness of 2.0 μm(silver amount: 0.7 g/m$^2$).

5th Layer: High Speed Green-Sensitive Emulsion Layer 1,000 g of an emulsion which was obtained in the same manner as in the emulsion of the 1st layer, except that 1-(2,4,6-trichlorophenyl)-3-[3-(2,4-di-t-amylphenoxyacetamide)benzamide]-5-pyrazolone was used as a magenta coupler instead of the cyan coupler, was blended with 1 kg of a green-sensitive high speed silver iodobromide emulsion (iodine content: 3.5 mol %, and particle size: 0.6 μm), and the resultant emulsion was applied so as to result in a dry film thickness of 1 μm. The emulsion for the green-sensitive layer was subjected to chemical sensitization processing in the same manner as that for the red-sensitive layer. (Coated silver amount: 0.35 g/m$^2$).

6th Layer: Intermediate Layer 1 kg of an emulsion as used in the 3rd layer was blended with 1 kg of 10% aqueous solution of gelatin, and the mixture was applied so as to result in a dry film thickness of 1 μm.

7th Layer: Yellow Filter Layer

An emulsion containing yellow colloidal silver was applied so as to result in a dry film thickness of 1 μm.

8th Layer: Low Speed Blue-Sensitive Emulsion Layer 1,000 g of an emulsion which was obtained in the same manner as for the emulsion of the 1st layer, except that α-(pivaloyl)-α-(1-benzyl-5-ethoxy-3-hydantoinyl)-2-chloro-5-dodecyloxycarbonylacetanilide was used as a yellow coupler instead of the cyan coupler, was blended with 1 kg of a blue-sensitive low speed silver iodobromide emulsion (iodine content: 4.5 mol %, and particle size: 0.8 μm), and the resultant emulsion was applied so as to result in a dry film thickness of 2.0 μm(coated silver amount: 0.6 g/m$^2$).

9th Layer: High Speed Blue-Sensitive Emulsion Layer 1,000 g of an emulsion which was obtained in the same manner as the emulsion of the 1st layer, except that α-(pivaloyl)-α-(1-benzyl-5-ethoxy-3-hydantoinyl)-2-chloro-5-dodecyloxycarbonylacetanilide was used as a yellow coupler instead of the cyan coupler, was blended with 1 kg of a blue-sensitive high speed silver iodobromide emulsion (iodine content: 3.5 mol %, and particle size: 1.5 μm), and the resultant emulsion was applied so as to result in a dry film thickness of 1.0 μm (coated silver amount: 0.5 g/m$^2$).

The emulsion for the blue-sensitive layer was chemically sensitized in the same manner as that for the red-sensitive layer.

10th Layer: 2nd Protective Layer 1 kg of an emulsion as used for the 3rd layer was blended with 1 kg of 10% aqueous solution of gelatin, and the resultant mixture was applied so as to result in a dry film thickness of 2 μm.

11th Layer: 1st Protective Layer

A 10% aqueous solution of gelatin containing a fine grain emulsion (particle size: 0.15 μm, 1 mol % silver iodobromide emulsion) which was not chemically sensitized) was applied so as to result in a coated silver amount of 0.3 g/m$^2$ and a dry film thickness of 1 μm.

Each of the silver halide emulsions shown above contains a silver halide and a gelatin in a weight ratio of 1.2:1, respectively.

The resultant multilayer coated film was used as Sample 18.

Instead of the emulsion for the 2nd layer of Sample 18, an emulsion which was obtained by covering the surface of silver halide grains in the above-described emulsion with a shell by the same method as in Example 2 (shell thickness: 75 Å) was used to obtain Sample 19.

The resultant Samples 18 and 19 were exposed to light through an optical wedge and subjected to development processing in the same manner as in Example 1.

Each sample was measured to obtain the logarithm of the reciprocal of the relative exposure which gave a cyan density of 2.50 (hereinafter referred to as "S 2.5"), and the results shown in Table 3 were obtained.

TABLE 3

| | Sample 18 (Comparative Example) | Sample 19 (The Present Invention) |
|---|---|---|
| S 2.5 | 3.15 | 3.34 |

It can be seen that the sensitivity increases when the core/shell type emulsion of the present invention is used.

EXAMPLE 4

A photographic emulsion comprising mono-dispersed octahedral grains of silver iodobromide containing 2.5 mol % of silver iodide (hereinafter, this emulsion was named Emulsion A) was subjected to gold sensitization and sulfur sensitization.

As the gold sensitizer, tetrachloroaurate and potassium thiocyanate were used together.

As the sulfur sensitizer, hypo was used.

To the resultant photographic emulsion, an aqueous solution of silver nitrate and an aqueous solution of potassium halide (aqueous solution of a mixture of KBr and KI) were added at the same time by a double jet process to cover the grains with a shell composed of silver iodobromide containing 2.5 mol % of silver iodide. The thickness of the shell was varied as shown in Table 4. The resultant core/shell type emulsion having a shell thickness of 101 Å was named Emulsion B and that having a shell thickness of 150 Å was named Emulsion C.

To each of the resultant core/shell type emulsions, 3.3'-di(3-sulfopropyl)-9-ethyl-naptho[1,2-d]thiacarbocyanine sodium salt and 5,5'-dichloro-3,3-di(3-sulfobutyl)-9-ethyl-thiacarbocyanine sodium salt were added in an amount of $2.6\times10^{-4}$ mol per mol of silver halide, respectively, as sensitizing dyes to carry out spectral sensitization.

Further, an emulsion which was prepared by dissolving a mixture composed of 70 g of 2-(heptafluorobutyramide)-5-[2'-(2'',4''-di-t-amylphenoxy)-butyramide]-phenol and 30 g of 2-(heptafluorobutyramide)-5-[2'-(2'',4''-di-t-amylphenoxy)hexylamide]phenol as cyan couplers in a mixture composed of 50 cc of tricresyl phospate and 100 cc of ethyl acetate, and stirring at a high rate together with 1 kg of a 10% aqueous solution of gelatin, was added to the above-described emulsion and, further, a stabilizer, a conventional pH controller and a viscosity increasing agent were added thereto. The resultant emulsion containing a silver halide and a gelatin in a weight ratio of 1.2:1 was applied so as to provide a coated silver amount of 10 mg/100 cm$^2$.

Further, to the resultant light-sensitive layer, a layer comprising gelatin, a matting agent, a pH controller, a surface active agent, a viscosity increasing agent and a hardening agent was applied as a surface protective layer so as to provide a dry film thickness of 1.5 μm, and the same was dried. The resultant samples were named Sample 101 and Sample 102.

Next, Emulsions D and E (corresponding to the emulsion of U.S. Pat. No. 4,444,877) were prepared as follows:

To Emulsion A obtained above, an aqueous solution of silver nitrate and an aqueous solution of potassium bromide were simultaneously added by a double jet process to cover the grains with a shell of silver bromide. The thickness of the shell was varied as shown in Table 4 below. That is, the shell thickness of Emulsion D was 101 Å and that of Emulsion E was 150 Å. The resultant emulsion was subjected to gold sensitization and sulfur sensitization. As the gold sensitizer tetrachloroacurate and potassium thiocyanate were used together. As the sulfur sensitizer hypo was used. Thus, Emulsions D and E were obtained.

The thus obtained Emulsions D and E were subjected to spectral sensitization, and then a cyan coupler, a stabilizer, a conventional pH controller and a viscosity increasing agent were added thereto in the same manner as in Emulsions B and C described above. The resultant emulsion was coated on a support in a coated silver amount of 10 mg/100 cm$^2$. Further, to the resultant light-sensitive layer, the same protective layer as used in Samples 101 and 102 described above was applied in a dry thickness of 1.5 μm. The resultant samples were named Sample 103 and Sample 104.

Samples 101 to 104 were stored under the conditions described in Table 5 below and then, exposed to light and subjected to development processing using the same processing solutions and conditions as used in Example 1.

The color sensitized sensitivity S of each of the thus treated Samples was measured and evaluated in the same manner as disclosed in Example 1. The difference between S value of each sample under each storage condition and S value of each sample stored at ordinary temperature and humidity was calculated and represented by ΔS.

TABLE 4

| Sample No. | Emulsion | Shell Thickness (A) | Chemical Sensitization of Core | Chemical Sensitiazation of Shell |
|---|---|---|---|---|
| 101 (Present Invention) | B | 101 | conducted | none |
| 102 (Present Invention) | C | 150 | conducted | none |
| 103* (Comparison) | D | 101 | none | conducted |
| 104* (Comparison) | E | 150 | none | conducted |

*The emulsion described in U.S. Pat. No. 4,444,877 was used.

TABLE 5

| Sample | D max and ΔS after storage | | | | | | | |
|---|---|---|---|---|---|---|---|---|
| | 3 days at ordinary temperature and humidity* | | 3 days at 55° C., 30% RH | | 3 days at 55° C., 55% RH | | 3 days at 45° C. 80% RH | |
| No. | D max | ΔS | D max | ΔS | D max | ΔS | D max | ΔS |
| 101 | 2.80 | 0.00 | 2.73 | +0.01 | 2.60 | 0.00 | 2.53 | −0. |
| 102 | 2.82 | 0.00 | 2.76 | 0.00 | 2.65 | 0.00 | 2.62 | −0.01 |

TABLE 5-continued

| Sample No. | D max and ΔS after storage: 3 days at ordinary temperature and humidity* D max | ΔS | 3 days at 55° C., 30% RH D max | ΔS | 3 days at 55° C., 55% RH D max | ΔS | 3 days at 45° C. 80% RH D max | ΔS |
|---|---|---|---|---|---|---|---|---|
| 103 | 2.80 | 0.00 | 2.50 | +0.02 | 2.42 | +0.02 | 2.31 | +0.09 |
| 104 | 2.81 | 0.00 | 2.52 | +0.02 | 2.45 | +0.03 | 2.34 | +0.11 |

*25° C. and 68% RH are employed.

The other fresh Samples 101 to 104 were firstly exposed to light under the same condition as described in Example 1, and then stored under the respective condition described in Table 6 below. After storage, these samples were subjected to development processing under the same conditions as described in Example 1. Each color sensitized sensitivity of the thus treated samples was measured in the same manner as above. The difference between the S value of each sample under each storage condition and the S value of each sample stored under refrigeration (−10° C.) for 3 days was calculated and represented by ΔS.

TABLE 6

| Sample No. | Storage Condition: 3 days under refrigeration (−10° C.) D max | ΔS | 3 days at 45° C., 30% RH D max | ΔS | 3 days at 45° C., 55% RH D max | ΔS | 3 days at 45° C., 80% RH D max | ΔS |
|---|---|---|---|---|---|---|---|---|
| 101 | 2.80 | 0.00 | 2.75 | −0.01 | 2.73 | −0.01 | 2.50 | 0.00 |
| 102 | 2.81 | 0.00 | 2.75 | −0.01 | 2.74 | 0.00 | 2.52 | 0.00 |
| 103 | 2.80 | 0.00 | 2.70 | −0.03 | 2.72 | −0.03 | 2.30 | −0.04 |
| 104 | 2.82 | 0.00 | 2.73 | −0.04 | 2.73 | −0.04 | 2.30 | −0.05 |

As is obvious from Table 5, in Samples 103 and 104 (comparison) D max tends to decrease and S tends to increase under more severe storage conditions (that is, 55° C., 30% RH; 55° C., 55% RH; 45° C., 80% RH in order) as compared with the storage at ordinary temperature and humidity. On the other hand, in Samples 101 and 102 (the present invention) the decrease of D max and increase of S under severe storage conditions are markedly prevented. This means that in the present invention storage stability is markedly improved.

The same conclusion can be made based on the results shown in Table 6. That is, with Samples 103 and 104 D max tends to decrease and S tends to decrease under more severe storage conditions as compared with the storage under refrigeration, while with Samples 101 and 102 the decrease of D max and decrease of S under the severe storage condition are markedly prevented.

In the present invention nuclei of chemical sensitization and those of sensitivity exist in the interior of the silver halide grains; therefore, it is believed that they are barely affected by exterior conditions.

While the invention has been described in detail and with reference to specific embodiments thereof, it will be apparent to one skilled in the art that various changes and modifications can be made therein without departing from the spirit and scope thereof.

What is claimed is:

1. In a method of developing on imagewise exposed silver halide photographic light-sensitive materials comprising at least one spectrally sensitized silver halide emulsion layer on a support, the improvement wherein said spectrally sensitized silver halide emulsion layer contains core-shell type silver halide grains having a shell thickness of 25 to 150 Å wherein the core is not fogged, the surface of the core is subjected to chemical sensitization and the sufface of the shell is not subjected to chemical sensitization, wherein the developing solution used contains a sulfur containing solvent for silver halide, and wherein a positive image is formed sequentially by a first development comprising black and white photographic processing; a reversal processing; and a second development comprising color development processing.

2. A method of developing silver halide photographic light-sensitive materials as claimed in claim 1, wherein the solvent for silver halide is a compound having a chemical species selected from the group consisting of $SCN^-$, $SO_3^{2-}$, $S_2O_5^{2-}$ and $S_2O_3^{2-}$.

3. A method of developing silver halide photographic light-sensitive materials as claimed in claim 2, wherein the solvent for silver halide is a compound selected from the group consisting of KSCN, NaSCN, $K_2SO_3$, $Na_2SO_3$, $K_2S_2O_5$, $Na_2S_2O_5$, $K_2S_2O_3$ and $Na_2S_2O_3$.

4. A method of developing silver halide photographic light-sensitive materials as claimed in claim 1, wherein the developing solution contains a compound having a chemical species of $SCN^-$ as a solvent for silver halide in an amount of 0.005 to 0.02 mol per liter of the developing solution.

5. A method of developing silver halide photographic light-sensitive materials as claimed in claim 1, wherein the developing solution contains a compound having a chemical species of $SO_3^{2-}$ as a solvent for silver halide in an amount of 0.05 to 1 mol per liter of the developing solution.

6. A method of developing silver halide photographic light-sensitive materials as claimed in claim 1, wherein the developing solution contains a compound having a chemical species of $S_2O_5^{2-}$ as a solvent for silver halide in an amount of 0.025 to 0.5 mol per liter of the developing solution.

7. A method of developing silver halide photographic light-sensitive materials as claimed in claim 1, wherein the developing solution contains a compound having a chemical species of $S_2O_3^{2-}$ as a solvent for silver halide in an amount of 0.005 to 0.02 mol per liter of the developing solution.

8. A method of developing silver halide photographic light-sensitive materials as claimed in claim 1, wherein the surface of the core is subjected to chemical sensitization using a sulfur sensitization process or a noble metal sensitization process.

9. A method of developing silver halide photographic light-sensitive materials as claimed in claim 5, wherein the developing solution contains a compound having a chemical species of $SO_3^{2-}$ as a solvent for silver halide in an amount of 0.1 to 0.5 mol per liter of the developing solution.

10. A method of developing silver halide photographic light-sensitive materials as claimed in claim 6, wherein the developing solution contains a compound having a chemical species of $S_2O_5^{2-}$ as a solvent for silver halide in an amount of 0.05 to 0.25 mol per liter of the developing solution.

11. A method of developing silver halide photographic light-sensitive materials as claimed in claim 7, wherein the developing solution contains a compound having a chemical species of $S_2O_3^{2-}$ as a solvent for silver halide in an amount of 0.01 to 0.015 mol per liter of the developing solution.

12. A method of developing silver halide photographic light-sensitive materials as claimed in claim 1, wherein the particle sizes of the core/shell type silver halide grains are in a range of 0.1 to 5 μm.

13. A method of developing silver halide photographic light-sensitive materials as claimed in claim 12, wherein the particle sizes of the core/shell type silver halide grains are in a range of 0.1 to 3 μm.

14. A method of developing silver halide photographic light-sensitive materials as claimed in claim 1, wherein a processing temperature is selected from the range of 18° C. to 50° C.

15. A method of developing silver halide photographic light-sensitive materials as claimed in claim 1, wherein the core comprises silver iodobromide containing 0–10 mol % silver iodide and the shell comprises silver iodobromide containing 0–10 mol % silver iodide.

16. A method of developing silver halide photographic light-sensitive materials as claimed in claim 1, wherein the core comprises silver iodobromide containing 0–5 mol % silver iodide and the shell comprises silver iodobromide containing 0–5 mol % silver iodide.

17. A method of developing silver halide photographic light-sensitive materials as claimed in claim 1, wherein the silver halide grains have a two-layer structure.

18. A method of developing silver halide photographic light-sensitive materials as claimed in claim 1, wherein the developing solution contains a compound having a chemical species of $SCN^-$ as a solvent for silver halide in an amount of 0.01 to 0.015 mol per liter of the developing solution.

* * * * *